United States Patent [19]

Harrigal

[11] Patent Number: 4,615,392

[45] Date of Patent: Oct. 7, 1986

[54] RECOVERING OIL BY INJECTING HOT $CO_2$ INTO A RESERVOIR CONTAINING SWELLING CLAY

[75] Inventor: Robert L. Harrigal, Bakersfield, Calif.

[73] Assignee: Shell California Production Inc., Houston, Tex.

[21] Appl. No.: 700,786

[22] Filed: Feb. 11, 1985

[51] Int. Cl.[4] ..... E21B 43/22

[52] U.S. Cl. ..... 166/272; 166/303

[58] Field of Search ..... 166/272, 303

[56] References Cited

U.S. PATENT DOCUMENTS

| | | | |
|---|---|---|---|
| 3,442,332 | 5/1969 | Keith | 166/272 |
| 3,480,082 | 11/1969 | Gilliland | 166/303 |
| 4,042,029 | 8/1977 | Offeringa | 166/272 |

*Primary Examiner*—Stephen J. Novosad
*Assistant Examiner*—Bruce Kisliuk

[57] ABSTRACT

In a heavy oil reservoir containing water-sensitive clay which impedes injections of either steam or cold $CO_2$, oil is produced by injecting $CO_2$ vapor at more than about 130° F. at a pressure below the critical pressure for the $CO_2$ or fracturing pressure for the reservoir.

4 Claims, 3 Drawing Figures

VEDDER 31 CO2 SOAK - PYRAMID HILL FORMATION

VEDDER 52 CO2 SOAK-PYRAMID HILL FORMATION

VEDDER 4 CO2 OFFSET PRODUCER - PYRAMID HILL FORMATION

RECOVERING OIL BY INJECTING HOT $CO_2$ INTO A RESERVOIR CONTAINING SWELLING CLAY

BACKGROUND OF THE INVENTION

The present invention relates to injecting $CO_2$ into a reservoir containing swelling clay. More particularly, the invention provides a method for increasing the oil recovery obtainable by injecting an oil mobilizing and oil displacing proportion of $CO_2$ into an oil containing reservoir having a combination of permeability and swelling clay content capable of significantly impeding the injection of heated or unheated aqueous fluid or unheated $CO_2$.

It is commonly known that $CO_2$ can be injected in various types of oil reservoirs in order to increase the amount of oil recovery from either cyclic or continuous oil displacement processes by becoming dissolved in the oil and increasing its mobility and/or displacing the oil into a production location within the reservoir. In addition, $CO_2$ has been injected into reservoirs at various temperatures for various reasons, for example, as described in the following patents: U.S. Pat. No. 3,442,332 relates to using a combination of producing $CO_2$ while producing ammonia, and using the $CO_2$ to recover oil by injecting it at the lowest temperature at which it provides a producible oil viscosity at a suitable injection pressure. U.S. Pat. No. 4,042,029 describes producing oil from an extensively fractured reservoir by injecting $CO_2$, heated if desired, into a gaseous zone overlying a liquid zone within the reservoir and producing oil from the liquid zone. U.S. Pat. No. 4,325,432 describes a process of injecting internal engine combustion gas treated with mangenese or manganese dioxide, at temperatures greater than 400° F., into an oil or oil shale reservoir. U.S. Pat. No. 4,429,744 describes a process of injecting $CO_2$ in steam, or in slugs alternated with steam, while using a specified schedule of production pressure recycling in a fluid drive oil production process.

But, where an oil reservoir has a combination of permeability and swelling clay content capable of significantly impeding the injection of steam or other hot or cold aqueous fluid or unheated $CO_2$ in order to increase the mobility of the oil and its displacement toward a production location; as far as the Applicant is aware, the problem of how to effect an economical recovery of the oil has heretofore remained unsolved.

SUMMARY OF THE INVENTION

The present invention relates to improving a process for recovering oil from a subterranean reservoir by injecting fluid for increasing the mobililty of the oil and displacing it toward the production location in spite of the reservoir having a combination of permeability and swelling clay content capable of significantly impeding an injection of hot or cold aqueous fluid or unheated $CO_2$. The improvement is provided by injecting a fluid which consists essentially of gaseous $CO_2$ at a temperature high enough to materially increase its mobility within the reservoir at conditions not productive of a critical state for the injected fluid or the fracturing pressure for the reservoir.

DESCRIPTION OF THE INVENTION

Figure 1:
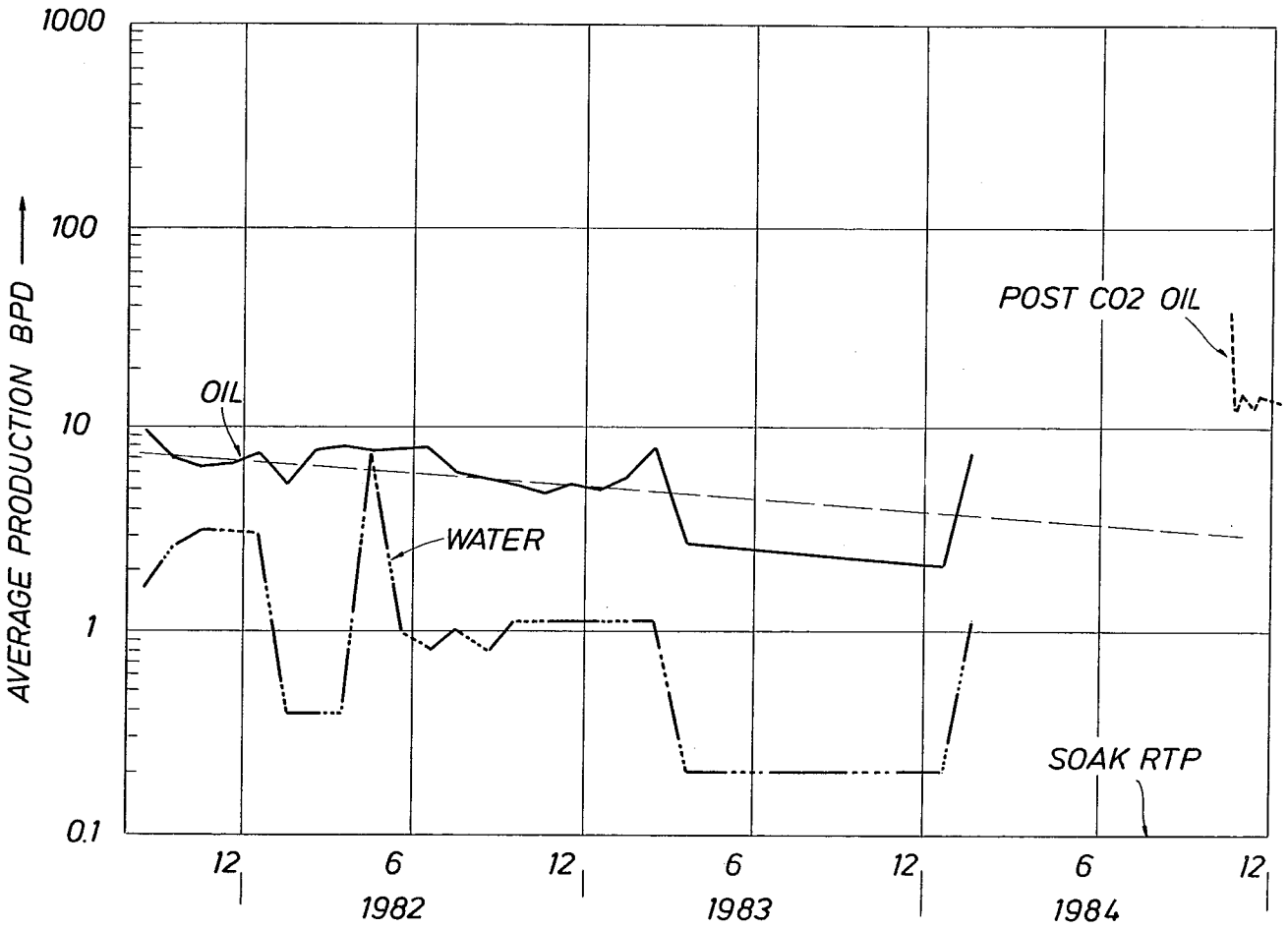
FIGS. 1 and 2 show the relative rates of oil production in the hot $CO_2$ soak wells before and after applications of the present process.

The present invention is, at least in part, premised on a discovery that with respect to a reservoir having a combination of swelling clay content and permeability which significantly impedes the injection of aqueous fluid or unheated $CO_2$, a gaseous fluid consisting essentially of heated $CO_2$ can provide a capability of both inflowing into the reservoir at rates significantly higher than unheated $CO_2$ and displacing oil within the reservoir toward a production location at a rate significantly greater than could have been obtained by injecting unheated or heated aqueous fluid or unheated $CO_2$.

The Pyramid Hill sand in the Mount Poso field is a reservoir formation typical of the type for which the present process is particularly useful. Its composition is shown in Table 1. A typical Pyramid Hill recovery history is summarized in Table 2. All previously attempted recovery mechanisms, as summarized in Table 2, have failed due to low or no injectability.

TABLE 1

PYRAMID HILL SANDS
Mineral Composition Analysis

| | WEIGHT PERCENT | | | | | | |
|---|---|---|---|---|---|---|---|
| | 1 | 2 | 3 | 4 | 5 | 6 | 7 |
| Crystalline Component | | | | | | | |
| Quartz | 22 | 30 | 22 | 14 | 27 | 30 | 19 |
| Feldspar | 40 | 35 | 35 | 35 | 40 | 35 | 30 |
| Dolomite | 1 | 1 | 1 | — | — | 1 | 1 |
| Pyrite | 2 | 2 | 2 | 1 | — | 1 | — |
| Clay | 35 | 30 | 40 | 50 | 30 | 30 | 50 |
| Clay Component | | | | | | | |
| Montmorillinite | 70 | 70 | 85 | 90 | 70 | 70 | 80 |
| Illite | 20 | 20 | 10 | 5 | 20 | 20 | 15 |
| Chlorite | 10 | 10 | 5 | 5 | 10 | 10 | 5 |

TABLE 2

PYRAMID HILL SAND RECOVERY HISTORY

| DATE | COMPANY | FIELD | PROJECT/TECHNIQUE | OUTCOME |
|---|---|---|---|---|
| 1952–1960 | Non-Shell | Mt. Poso | Sarrett & Mack Pilot water flood. Wells 43–47. Diluent oil, Acidize, fracture attempted to stimulate production and injection. | Low injectivity. Acid jobs evaluated as no improvement. Fracture treatment attempted and evaluated as a failure. Result; after 8 years, injection was terminated. Project was a failure. Dilution of oil with a solvent also failed. |
| 1982 | Shell | Mt. Poso | Acidize Vedder-Rall 372 to return to production. | Acidize attempted to reduce swelled clays after well had ceased flow. Result; Acid pumped in and no flow back. Failure. |

TABLE 2-continued

| | | PYRAMID HILL SAND RECOVERY HISTORY | | |
|---|---|---|---|---|
| DATE | COMPANY | FIELD | PROJECT/TECHNIQUE | OUTCOME |
| 1982 | Shell | Mt. Poso | Acidize Vedder 34 to improve rate of production. | Could not pump acid into formation. Well returned at pre stimulation rate; job failed. |
| 1982 | Shell | Mt. Poso | Steam soak Vedder 268 attempted to stimulate production by reducing oil viscosity. | Steam injected into well with no flow back when returned to production; job failed. |
| 1984 | Shell | Round Mountain | Injectivity Test for waterflood evaluation. | Formation took no water; job failed, due to low injectivity. |
| 1984 | Shell | Mt. Poso | Hot $CO_2$ soak program; Vedder 52 and Vedder 31. | Higher injectability than anticipated. Successfully stimulated soak wells with initial rates of 4–5 times pre-stimulation and 2–3 times after two months. Also, offset well exhibited a doubling in Gross production and a 50% increase in oil production at a distance of 500–600' away from injected location. |

Each of the projects and techniques listed in Table 2, prior to the hot $CO_2$ soak program in Vedder #52 and Vedder #31, employed conventional materials and procedures. In the hot $CO_2$ treatment, liquid $CO_2$ was vaporized, compressed to 1000 psi, then heated to a gas at about 130° to 160° F. and injected into the well. The effect of the heat on the $CO_2$ is clearly shown in Table 3.

TABLE 3

| Time | Cumulative Pounds | Wellhead Temp. | Surface Pressure | Downhole Pressure | $CO_2$ Liquid Temp. | Rate | Density |
|---|---|---|---|---|---|---|---|
| 9:00 P | 0 | 130° F. | 950 psi | 1000 psi | 6.0° F. | 15 gpm | 9.0 lb/gal |
| 9:30 | 7500 | 135 | 900 | 1030 | 5.8 | 18 | 8.56 |
| 10:00 | Restart | | | | | | |
| 10:00 | 0 | 120 | 932 | 1050 | 3.8 | 25 | 8.6 |
| 10:30 | 6600 | 130 | 934 | 1050 | 4.6 | 26 | 8.6 |
| 11:00 | 13500 | 125 | 950 | 1060 | 4.0 | 28 | 8.6 |
| 12:00 P | 28500 | 120 | 956 | 1065 | 5.1 | 26 | 8.6 |
| | | | | 9/20/84 | | | |
| 1:00 A | 43300 | 125 | 952 | 1060 | 6.5 | 25 | 8.56 |
| 2:00 | 56500 | 130 | 935 | 1060 | 8.1 | 25 | 8.5 |
| 3:00 | 68100 | 125 | 930 | | 8.0 | 25 | 8.5 |
| 4:00 | 84200 | 120 | 930 | | 8.3 | 25 | 8.51 |
| 5:00 | 97000 | 120 | 928 | | 7.7 | 25 | 8.53 |
| 6:00 | 109200 | 120 | 930 | | 7.5 | 25 | 8.53 |
| 7:00 | 121600 | 125 | 937 | | 7.9 | 25 | 8.52 |
| 8:00 | 134700 | 134 | 941 | | 7.8 | 25 | 8.52 |
| 9:00 | 146800 | 130 | 946 | | 8.2 | 24 | 8.52 |
| 10:00 | 161700 | 132 | 953 | | 7.3 | 25 | 8.53 |
| 10:37 | | 145 | 960 | | 6.9 | 32 | 8.55 |
| 11:00 | 175200 | 130 | 950 | 1065 | 7.5 | 33 | 8.53 |
| 12:00 A | 188700 | 130 | 948 | 1100 | 7.7 | 32 | 8.52 |
| 1:00 P | 204200 | 120 | 977 | 1090 | 5.47 | 40 | 8.59 |
| 2:00 | 223400 | 120 | 975 | 1050 | 4.9 | 37 | 8.60 |
| 3:00 | 242000 | 140 | 965 | 1050 | 5.9 | 32 | 8.51 |
| 4:00 | 255000 | 160 | 868 | 1000 | 5.5 | 20 | 8.57 |
| 5:00 | 268100 | 125 | 965 | 1050 | 5.9 | 35 | 8.58 |
| 6:00 P | 285500 | 140 | 926 | 1035 | 6.9 | 28 | 8.54 |
| 7:00 | 300600 | 140 | 990 | 1090 | 5.3 | 30.0 | 8.6 |
| 8:00 | 318100 | 130 | 1000 | 1099 | 5.6 | 35.0 | 8.6 |
| 9:00 | 337200 | 135 | 995 | 1095 | 5.8 | 35.0 | 8.5 |
| 10:00 | 335900 | 130 | 1000 | 1098 | 8.1 | 35.0 | 8.5 |
| 11:00 | 370800 | 130 | 860 | 980 | 7.0 | 20.0 | 8.5 |
| 12:00 A | 376300 | | Shut Down to Change Pumps 9/21/84 | | | | |
| 1:30 A | 379500 | 120 | 948 | 1100 | 4.65 | | 8.6 |

A low rate of about 15 to 18 gallons per minute at pressures of 1000–1030 psi was exhibited initially. As the heat from the inflowing 130° F. $CO_2$ began to raise the temperature of the rocks near the well, the injectability increased to 25 gallons per minute. When the temperature was increased to 140° F. the injectability increased to 35 gallons per minute with the bottom hole pressure staying at about 1000–1050 psi. Throughout the treatment it was apparent that when the temperature increased up to about 140° F. the bottom hole pressure dropped, for example from about 1078 to 1046 psi. When the temperature dropped, for example from 104° to 85° F. the bottom hole pressure increased, for example from 1106 to 1145 psi, all of which is indicative of a better injectability with hotter $CO_2$.

Figure 2:
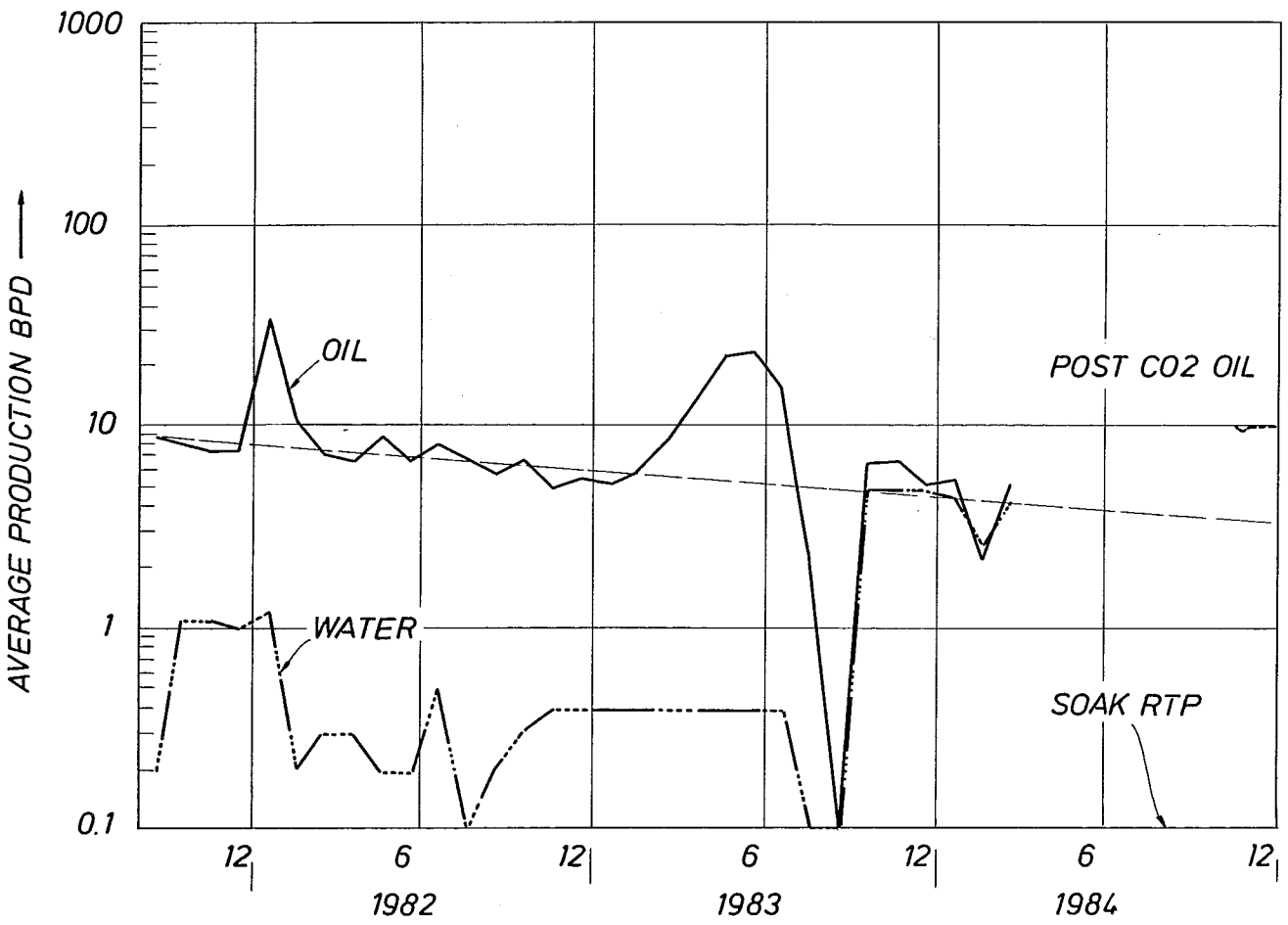

The effects of the hot $CO_2$ soak on the Vedder #31 and Vedder #52 wells are shown in FIGS. 1 and 2. The "post $CO_2$ oil" initiated by the return to production (RTP) after the $CO_2$ soak near the right hand portions of the curves, indicate the dramatic increase in oil production which resulted from the injection of the hot $CO_2$. The indicated amounts of oil and water production prior to those treatments were the amounts attained in response to depletion drive processes initiated when the wells were opened into fluid communication with this reservoir.

Figure 3:
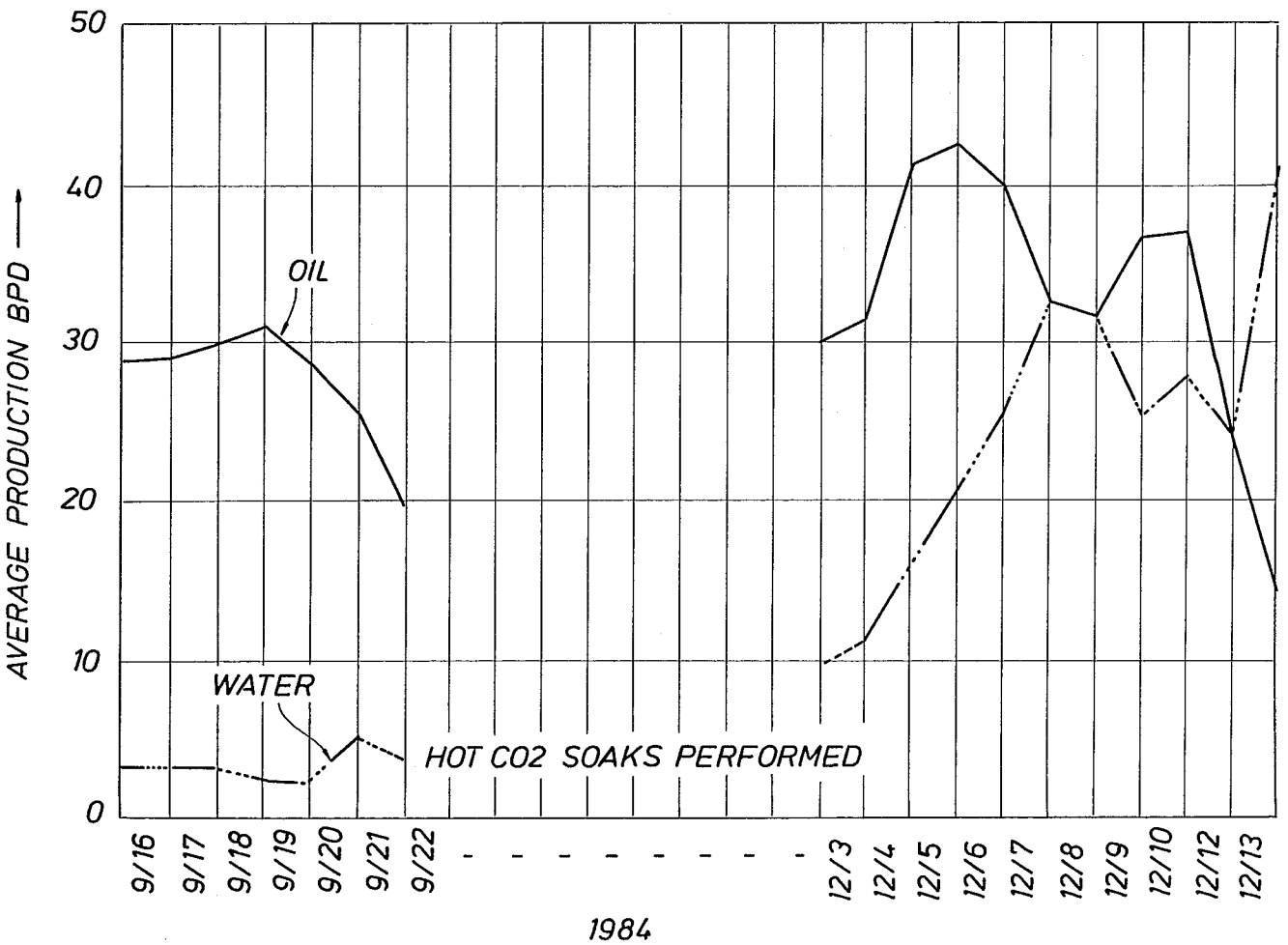
FIG. 3 shows the oil and water production rates before and after the present process at an offset well location approximately 600 feet from the injected locations.

The benefits of the hot $CO_2$ penetration deep into the formation are shown in FIG. 3. The oil and water production rates are shown before and after the hot $CO_2$ soaks took place. Prior to the application of the present process the well was produced by depletion methods only. Subsequent to the hot $CO_2$ soaks in Vedder #52 and Vedder #31, as shown in the Figure, a dramatic increase was exhibited in both the oil and water production rates. This response was recorded at a location some 600 feet from the injected locations and is evidence of deep penetration into the reservoir by the relatively small volume of hot $CO_2$.

SUITABLE COMPOSITIONS AND TECHNIQUES

In general, the reservoir formations for which the present process is particularly applicable, comprise oil-containing reservoirs of moderately low permeability such as about 50MD to 150MD and a relatively high concentration of a swelling clay such as a Bentonetic or montmorillinetic clay present in a concentration such as about 25% to 50% where the combination of reservoir permeability, swelling clay concentration, and oil viscosity, etc., interact to provide a significant impediment to the injection of unheated or heated aqueous liquids or unheated $CO_2$. A reservoir having properties typified by those of the Pyramid Hill sand in the Mount Poso field is a particularly good candidate for use of the present process.

In general, the $CO_2$ used in the present process can be one consisting essentially of $CO_2$. It can include mixtures of $CO_2$ with other relatively inert gases such as nitrogen, air, or the like in amounts up to about 10 percent as long as such other gases do not materially affect the capability of the $CO_2$ to enter into the reservoir and dissolve in and swell the oil.

The pressure at which the $CO_2$ is injected can be substantially any which is less than the reservoir fracturing pressure and less than a pressure at which the $CO_2$ being injected is substantially in its critical state. The temperature at which the $CO_2$ is injected is preferably one in which a significant increase is provided in the rate at which at the $CO_2$ enters the reservoir at a pressure suitable for use in that reservoir. In reservoirs having properties similar to those of the Pyramid Hill sand, temperatures in the order of 130°-150° F. are preferred.

The present process is particularly suited for use in a cyclic or soak, or huff and puff, tpye of operation. But, particularly where a plurality of cycles of hot $CO_2$ injection has extended heat throughout significant proportions of the reservoir zones between adjacent wells, the process can advantageously be converted to a hot $CO_2$ drive process with fluid being injected into one well while fluid is produced from another.

What is claimed is:

1. In a process for recovering oil by injecting fluid into an oil containing reservoir for increasing the mobility of the oil and displacing it toward a product location, where the reservoir is one in which a combination of reservoir properties inclusive of a permeability of about 50 to 150 md and swelling clay concentrations of about 25 to 35 percent interact to significantly impede injections of unheated or heated aqueous fluid or unheated $CO_2$, an improvement for injecting fluid capable of providing greater rates of flow into the reservoir and greater rates of oil displacement within the reservoir comprising:

injecting as said fluid a fluid consisting essentially of gaseous $CO_2$ at a temperature of about 130° to 160° F. which is high enough to heat the rocks near the well to an extent significantly reducing said flow impeding interaction of permeability and high swelling clay content of the rocks and thus increasing the mobility of the gaseous $CO_2$ within the reservoir at pressure and temperature conditions below those productive of the critical state for the injected gaseous fluid and below the fracturing pressure for the reservoir.

2. The process of claim 1 in which the $CO_2$ concentration of the injected fluid is at least about 90 percent.

3. The process of claim 1 in which the $CO_2$ is injected and fluid is produced in a cyclic process.

4. The process of claim 1 in which the $CO_2$ is injected through one well and fluid is produced from another well.

* * * * *